US010376005B2

(12) United States Patent
Albers

(10) Patent No.: US 10,376,005 B2
(45) Date of Patent: Aug. 13, 2019

(54) PORTABLE VACUUM CLEANING APPARATUS FOR A COMBUSTION CHAMBER

(71) Applicant: Jeffery Albers, Plain, WI (US)

(72) Inventor: Jeffery Albers, Plain, WI (US)

( * ) Notice: Subject to any disclaimer, the term of this patent is extended or adjusted under 35 U.S.C. 154(b) by 160 days.

(21) Appl. No.: 15/175,452

(22) Filed: Jun. 7, 2016

(65) Prior Publication Data

US 2016/0360939 A1 Dec. 15, 2016

Related U.S. Application Data

(60) Provisional application No. 62/172,842, filed on Jun. 9, 2015.

(51) Int. Cl.

| | |
|---|---|
| ***A47L 5/00*** | (2006.01) |
| ***A41D 19/00*** | (2006.01) |
| ***F23J 1/02*** | (2006.01) |
| ***A47L 5/36*** | (2006.01) |
| ***A47L 7/00*** | (2006.01) |
| ***A47L 9/24*** | (2006.01) |

(52) U.S. Cl.

CPC ..... *A41D 19/0082* (2013.01); *A47L 5/36* (2013.01); *A47L 7/0071* (2013.01); *A47L 9/248* (2013.01); *F23J 1/02* (2013.01)

(58) Field of Classification Search

CPC ..... A47L 7/009; A47L 7/242; A47L 7/248; A47L 7/04; A47L 7/0071; A47L 7/0014; F23J 1/02; B08B 15/02; B08B 15/026

USPC ..... D32/31, 33; 126/242–244, 542, 554; 15/300.1, 347, 352, 353, 458

See application file for complete search history.

(56) References Cited

U.S. PATENT DOCUMENTS

| | | | | |
|---|---|---|---|---|
| 3,334,955 A * | 8/1967 | Day | H01J 9/00 445/38 |
| 4,476,608 A * | 10/1984 | Rasmussen | A47L 7/0071 15/352 |
| 5,311,637 A * | 5/1994 | Broussard | F23J 3/026 110/165 R |
| 5,323,760 A | 6/1994 | Johnson | |
| 6,149,252 A * | 11/2000 | Browning | B08B 15/026 134/200 |
| 6,210,457 B1 * | 4/2001 | Siemers | B01D 45/16 55/429 |
| 2004/0089157 A1 * | 5/2004 | von Stackelberg, Jr. | A47L 5/365 96/406 |
| 2008/0142047 A1 * | 6/2008 | Buccos | B08B 15/026 134/21 |

(Continued)

*Primary Examiner* — Joseph J Hail
*Assistant Examiner* — Shantese L McDonald
(74) *Attorney, Agent, or Firm* — Mitchell A. Rossman; Terra Nova Patent Law, PLLC

(57) ABSTRACT

The present invention provides a portable vacuum cleaning apparatus for use on an opening in a combustion chamber. The portable vacuum cleaning apparatus includes: a shield with one or more connectors each independently configured to provide an air tight seal with an opening of a combustion chamber; a first aperture fitting protruding through the shield and connected to a first air hose with an air source and a second air hose with a nozzle; a second aperture fitting protruding through the shield and connected to a vacuum source, a third aperture fitting protruding through the shield and connected to a glove. Methods of using and systems for vacuum cleaning a combustion chamber are also provided.

11 Claims, 5 Drawing Sheets

(56) References Cited

U.S. PATENT DOCUMENTS

2014/0034645 A1* 2/2014 Jackson ..... B65F 1/141
220/260

* cited by examiner

PORTABLE VACUUM CLEANING APPARATUS FOR A COMBUSTION CHAMBER

RELATED APPLICATIONS

This application claims priority to U.S. Provisional Patent Application Ser. No. 62/172,842 filed Jun. 9, 2015, which is hereby incorporated by reference in its entirety for all purposes.

BACKGROUND OF THE INVENTION

Many homeowners use wood stoves and fireplaces to heat their homes. Typically, the wood stove or fireplace is located in a room, which also contains rugs, drapes, and furniture. These articles may become soiled by the ash and ash dust generated during the cleaning process. Further, there may be multiple stoves or fireplaces in the home that need to be cleaned.

Typically, the homeowner gently tries to remove the ash while generating as little ash dust as possible. If the homeowner tries to aggressively remove the caked-on ash inside the wood stove or fireplace, the homeowner will generate a lot of airborne ash dust. If the homeowner makes one careless move while removing the ash from the wood stove, the ash can fall directly onto the carpet or floor and fill the room with airborne ash dust. The homeowner must clean up the spill, vacuum off the furnishings to remove the deposited ash dust, and run an air filter to remove the smoky smell form the air.

What is needed is a low-cost portable vacuum cleaning apparatus that attaches to and seals the opening of the wood stove or fireplace thereby allowing the aggressive remove of ash from a wood stove or fireplace while preventing ash dust from depositing on the surroundings.

SUMMARY OF THE INVENTION

The present invention provides a portable vacuum cleaning apparatus for use on an opening in a combustion chamber. The portable vacuum cleaning apparatus includes: a shield with one or more connectors each independently configured to provide an air tight seal with an opening of a combustion chamber; a first aperture fitting protruding through the shield and connected to a first air hose with an air source and a second air hose with a nozzle; a second aperture fitting protruding through the shield and connected to a vacuum source, a third aperture fitting protruding through the shield and connected to a glove. Methods of using and systems for vacuum cleaning a combustion chamber are also provided.

The present invention provides the following advantages. First, the invention is portable thereby allowing the user to clean multiple wood stoves and/or fireplaces in their home. Second, the invention seals off the combustion chamber from the surroundings, thereby allowing the user to aggressively remove the caked-on ash inside the wood stove or fireplace. Third, the invention removes the ash and ash dust from the wood stove or fireplace without exposing the surroundings to the ash and ash dust. Fourth, the invention is affordable by being made of simple, readily available, and relatively low cost materials.

The present invention provides a portable vacuum cleaning apparatus for use on an opening in a combustion chamber. The portable vacuum cleaning apparatus includes: a shield having a first surface, a second surface, and one or more edges, wherein the one or more edges on the second surface of the shield each independently include one or more connectors each independently configured to provide an air tight seal with an opening of a combustion chamber; a first aperture fitting having a proximal end and a distal end and protruding through the shield, wherein the proximal end of the first aperture fitting is configured to receive a first air hose and the distal end of the first aperture fitting is configured to receive a second air hose in fluid connection with a nozzle; a second aperture fitting having a proximal end and a distal end and protruding through the shield, wherein the proximal end of the second aperture fitting is configured to receive a vacuum hose; a third aperture fitting having a proximal end and a distal end and protruding through the shield, and wherein the proximal end or the distal end of the third aperture fitting is configured to receive a glove.

In one embodiment, the combustion chamber includes a metal wood stove, a pellet burning metal wood stove, a metal fireplace, or a metal fireplace screen. In one embodiment, the metal wood stove, the pellet burning metal wood stove, or the metal fireplace are each independently configured to burn wood, charcoal, coal, corn, hay, straw, or a combination thereof. In one embodiment, the shield includes a transparent shield. In one embodiment, the vacuum hose is in fluid connection with a vacuum source. In one embodiment, the vacuum source includes an intake port of a shop vacuum. In one embodiment, the first air hose is in fluid connection with an air source. In one embodiment, the air source is an exhaust port of a shop vacuum. In one embodiment, the glove is a rubber glove, a nitrile glove, or a combination thereof. In one embodiment, the one or more connectors include one or more magnets and wherein the combustion chamber includes one or more ferromagnetic metals. In one embodiment, the one or more connectors include one or more adhesive strips. In one embodiment, the one or more adhesive strips are repositionable.

The present invention provides a portable vacuum cleaning apparatus for use on an opening in a combustion chamber. The portable vacuum cleaning apparatus includes: a transparent shield having a first surface, a second surface, and one or more edges, wherein the one or more edges on the second surface of the transparent shield each independently include one or more connectors each independently configured to provide an air tight seal with an opening of a combustion chamber; a first aperture fitting having a proximal end and a distal end and protruding through the transparent shield, wherein the proximal end of the first aperture fitting is configured to receive a first air hose in fluid connection with an air source and the distal end of the first aperture fitting is configured to receive a second air hose in fluid connection with a nozzle; a second aperture fitting having a proximal end and a distal end and protruding through the transparent shield, wherein the proximal end of the second aperture fitting is configured to receive a vacuum hose in fluid connection with a vacuum source; a third aperture fitting having a proximal end and a distal end and protruding through the transparent shield, wherein the proximal end or the distal end of the third aperture fitting is configured to receive a glove; and wherein the combustion chamber includes a metal wood stove, a pellet burning metal wood stove, a metal fireplace, or a metal fireplace screen.

In one embodiment, the vacuum source includes an intake port of a shop vacuum. In one embodiment, the air source is an exhaust port of a shop vacuum. In one embodiment, the glove is a rubber glove, a nitrile glove, or a combination thereof.

The present invention provides a portable vacuum cleaning apparatus for use on an opening in a combustion chamber. The portable vacuum cleaning apparatus includes: a transparent shield having a first surface, a second surface, and one or more edges, wherein the one or more edges on the second surface of the transparent shield each independently include one or more connectors each independently configured to provide an air tight seal with an opening of a combustion chamber; a first aperture fitting having a proximal end and a distal end and protruding through the transparent shield, wherein the proximal end of the first aperture fitting is configured to receive a first air hose in fluid connection with an exhaust port of a shop vacuum and the distal end of the first aperture fitting is configured to receive a second air hose in fluid connection with a nozzle; a second aperture fitting having a proximal end and a distal end and protruding through the transparent shield, wherein the proximal end of the second aperture fitting is configured to receive a vacuum hose in fluid connection with an exhaust port of a shop vacuum; a third aperture fitting having a proximal end and a distal end and protruding through the transparent shield, wherein the proximal end or the distal end of the third aperture fitting is configured to receive a glove; and wherein the combustion chamber includes a metal wood stove, a pellet burning metal wood stove, a metal fireplace, or a metal fireplace screen.

The present invention provides a method of vacuum cleaning a combustion chamber. The method includes: attaching a portable vacuum cleaning apparatus to an opening in a combustion chamber, wherein the portable vacuum cleaning apparatus includes: a shield having a first surface, a second surface, and one or more edges, wherein the one or more edges on the second surface of the shield each independently include one or more connectors each independently configured to provide an air tight seal with an opening of a combustion chamber; a first aperture fitting having a proximal end and a distal end and protruding through the shield, wherein the proximal end of the first aperture fitting is configured to receive a first air hose and the distal end of the first aperture fitting is configured to receive a second air hose in fluid connection with a nozzle; a second aperture fitting having a proximal end and a distal end and protruding through the shield, wherein the proximal end of the second aperture fitting is configured to receive a vacuum hose; a third aperture fitting having a proximal end and a distal end and protruding through the shield, and wherein the proximal end or the distal end of the third aperture fitting is configured to receive a glove; attaching the first air hose to the proximal end of the first aperture fitting and the second air hose to the distal end of the first aperture fitting; attaching a vacuum hose on the proximal end of the second aperture fitting; inserting a hand of a user into the glove and grabbing the nozzle; turning on a vacuum source and an air source; and directing the nozzle throughout the combustion chamber to remove a burned debris.

The present invention provides a method of vacuum cleaning a combustion chamber. The method includes: attaching a portable vacuum cleaning apparatus to an opening in a combustion chamber, wherein the portable vacuum cleaning apparatus includes: a transparent shield having a first surface, a second surface, and one or more edges, wherein the one or more edges on the second surface of the transparent shield each independently include one or more connectors each independently configured to provide an air tight seal with an opening of a combustion chamber; a first aperture fitting having a proximal end and a distal end and protruding through the transparent shield, wherein the proximal end of the first aperture fitting is configured to receive a first air hose in fluid connection with an air source and the distal end of the first aperture fitting is configured to receive a second air hose in fluid connection with a nozzle; a second aperture fitting having a proximal end and a distal end and protruding through the transparent shield, wherein the proximal end of the second aperture fitting is configured to receive a vacuum hose in fluid connection with a vacuum source; a third aperture fitting having a proximal end and a distal end and protruding through the transparent shield, wherein the proximal end or the distal end of the third aperture fitting is configured to receive a glove; wherein the combustion chamber includes a metal wood stove, a pellet burning metal wood stove, a metal fireplace, or a metal fireplace screen; attaching the first air hose to the proximal end of the first aperture fitting and the second air hose to the distal end of the first aperture fitting; attaching a vacuum hose on the proximal end of the second aperture fitting; inserting a hand of a user into the glove and grabbing the nozzle; turning on the vacuum source and the air source; and directing the nozzle throughout the combustion chamber to remove a burned debris.

The present invention provides a method of vacuum cleaning a combustion chamber. The method includes: attaching a portable vacuum cleaning apparatus to an opening in a combustion chamber, wherein the portable vacuum cleaning apparatus includes: a transparent shield having a first surface, a second surface, and one or more edges, wherein the one or more edges on the second surface of the transparent shield each independently include one or more connectors each independently configured to provide an air tight seal with an opening of a combustion chamber; a first aperture fitting having a proximal end and a distal end and protruding through the transparent shield, wherein the proximal end of the first aperture fitting is configured to receive a first air hose in fluid connection with an exhaust port of a shop vacuum and the distal end of the first aperture fitting is configured to receive a second air hose in fluid connection with a nozzle; a second aperture fitting having a proximal end and a distal end and protruding through the transparent shield, wherein the proximal end of the second aperture fitting is configured to receive a vacuum hose in fluid connection with an exhaust port of a shop vacuum; a third aperture fitting having a proximal end and a distal end and protruding through the transparent shield, wherein the proximal end or the distal end of the third aperture fitting is configured to receive a glove; and wherein the combustion chamber includes a metal wood stove, a pellet burning metal wood stove, a metal fireplace, or a metal fireplace screen; attaching the first air hose to the proximal end of the first aperture fitting and the second air hose to the distal end of the first aperture fitting; attaching a vacuum hose on the proximal end of the second aperture fitting; inserting a hand of a user into the glove and grabbing the nozzle; turning on the shop vacuum; and directing the nozzle throughout the combustion chamber to remove a burned debris.

The present invention provides a system for vacuum cleaning a combustion chamber. The system includes: a portable vacuum cleaning apparatus including: a shield having a first surface, a second surface, and one or more edges, wherein the one or more edges on the second surface of the shield each independently include one or more connectors each independently configured to provide an air tight seal with an opening of a combustion chamber; a first aperture fitting having a proximal end and a distal end and protruding through the shield, wherein the proximal end of the first aperture fitting is configured to receive a first air hose and the distal end of the first aperture fitting is configured to receive a second air hose in fluid connection with a nozzle; a second aperture fitting having a proximal end and a distal end and protruding through the shield, wherein the proximal end of the second aperture fitting is configured to receive a vacuum hose; a third aperture fitting having a proximal end and a distal end and protruding through the shield, wherein the proximal end or the distal end of the third aperture fitting is configured to receive a glove; and a vacuum and an air source.

The present invention provides a system for vacuum cleaning a combustion chamber. The system includes: a portable vacuum cleaning apparatus including: a transparent shield having a first surface, a second surface, and one or more edges, wherein the one or more edges on the second surface of the transparent shield each independently include one or more connectors each independently configured to provide an air tight seal with an opening of a combustion chamber; a first aperture fitting having a proximal end and a distal end and protruding through the transparent shield, wherein the proximal end of the first aperture fitting is configured to receive a first air hose in fluid connection with an air source and the distal end of the first aperture fitting is configured to receive a second air hose in fluid connection with a nozzle; a second aperture fitting having a proximal end and a distal end and protruding through the transparent shield, wherein the proximal end of the second aperture fitting is configured to receive a vacuum hose in fluid connection with a vacuum source; a third aperture fitting having a proximal end and a distal end and protruding through the transparent shield, wherein the proximal end or the distal end of the third aperture fitting is configured to receive a glove; wherein the combustion chamber includes a metal wood stove, a pellet burning metal wood stove, a metal fireplace, or a metal fireplace screen; and a vacuum and an air source.

The present invention provides a system for vacuum cleaning a combustion chamber. The system includes: a portable vacuum cleaning apparatus including: a transparent shield having a first surface, a second surface, and one or more edges, wherein the one or more edges on the second surface of the transparent shield each independently include one or more connectors each independently configured to provide an air tight seal with an opening of a combustion chamber; a first aperture fitting having a proximal end and a distal end and protruding through the transparent shield, wherein the proximal end of the first aperture fitting is configured to receive a first air hose in fluid connection with an exhaust port of a shop vacuum and the distal end of the first aperture fitting is configured to receive a second air hose in fluid connection with a nozzle; a second aperture fitting having a proximal end and a distal end and protruding through the transparent shield, wherein the proximal end of the second aperture fitting is configured to receive a vacuum hose in fluid connection with an exhaust port of a shop vacuum; a third aperture fitting having a proximal end and a distal end and protruding through the transparent shield, wherein the proximal end or the distal end of the third aperture fitting is configured to receive a glove, wherein the combustion chamber includes a metal wood stove, a pellet burning metal wood stove, a metal fireplace, or a metal fireplace screen; and a vacuum and an air source.

BRIEF DESCRIPTION OF THE DRAWINGS

Embodiments of the invention may be best understood by referring to the following description and accompanying drawings, which illustrate such embodiments. In the drawings.

Figure 1:
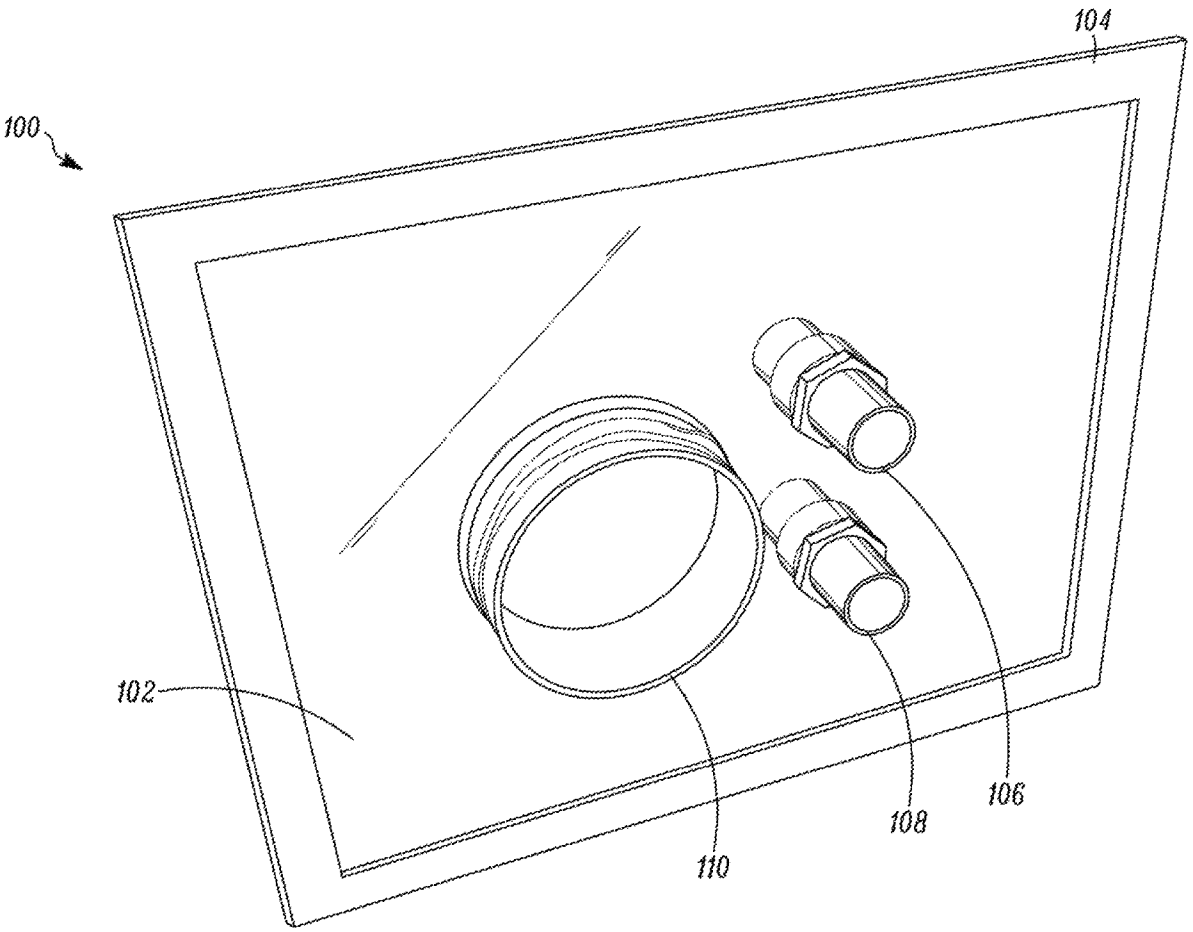
FIG. 1 is a front perspective-view drawing illustrating an exemplary portable vacuum cleaning apparatus without a glove for a combustion chamber.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a portable vacuum cleaning apparatus for use on an opening in a combustion chamber. The portable vacuum cleaning apparatus includes: a shield with one or more connectors each independently configured to provide an air tight seal with an opening of a combustion chamber; a first aperture fitting protruding through the shield and connected to a first air hose with an air source and a second air hose with a nozzle; a second aperture fitting protruding through the shield and connected to a vacuum source, a third aperture fitting protruding through the shield and connected to a glove. Methods of using and systems for vacuum cleaning a combustion chamber are also provided.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example, about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "comprising" or "comprises" is intended to mean that the compositions and methods include the recited elements, but not excluding others.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the phrase "operatively coupled" refers to bringing two or more items together or into relationship with each other such that they may operate together or allow transfer of information between the two or more items.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "proximal" refers to the closest end of an object. In contrast, the term "distal" refers to the farthest end of an object.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention illustratively disclosed herein suitably may be practiced in the absence of any element which is not specifically disclosed herein.

Figure 2:
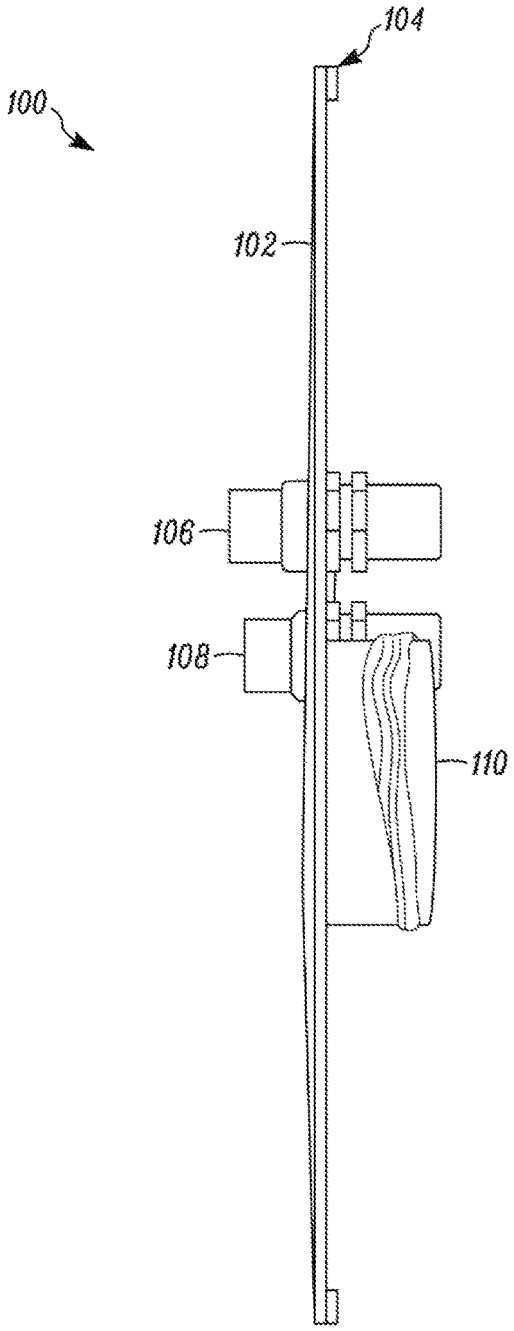
FIG. 2 is a side-view drawing illustrating an exemplary portable vacuum cleaning apparatus without a glove for a combustion chamber.

FIGS. 1-2 are front-perspective view and side view drawings illustrating an exemplary portable vacuum cleaning apparatus 100 for a combustion chamber (not shown). The portable vacuum cleaning apparatus 100 includes: a shield 102 with one or more connectors 104 each independently configured to provide an air tight seal with an opening (not shown) of a combustion chamber (not shown); a first aperture fitting 106 protruding through the shield 102; a second aperture fitting 108 protruding through the shield 102; and a third aperture fitting 110 protruding through the shield 102.

Figure 3:
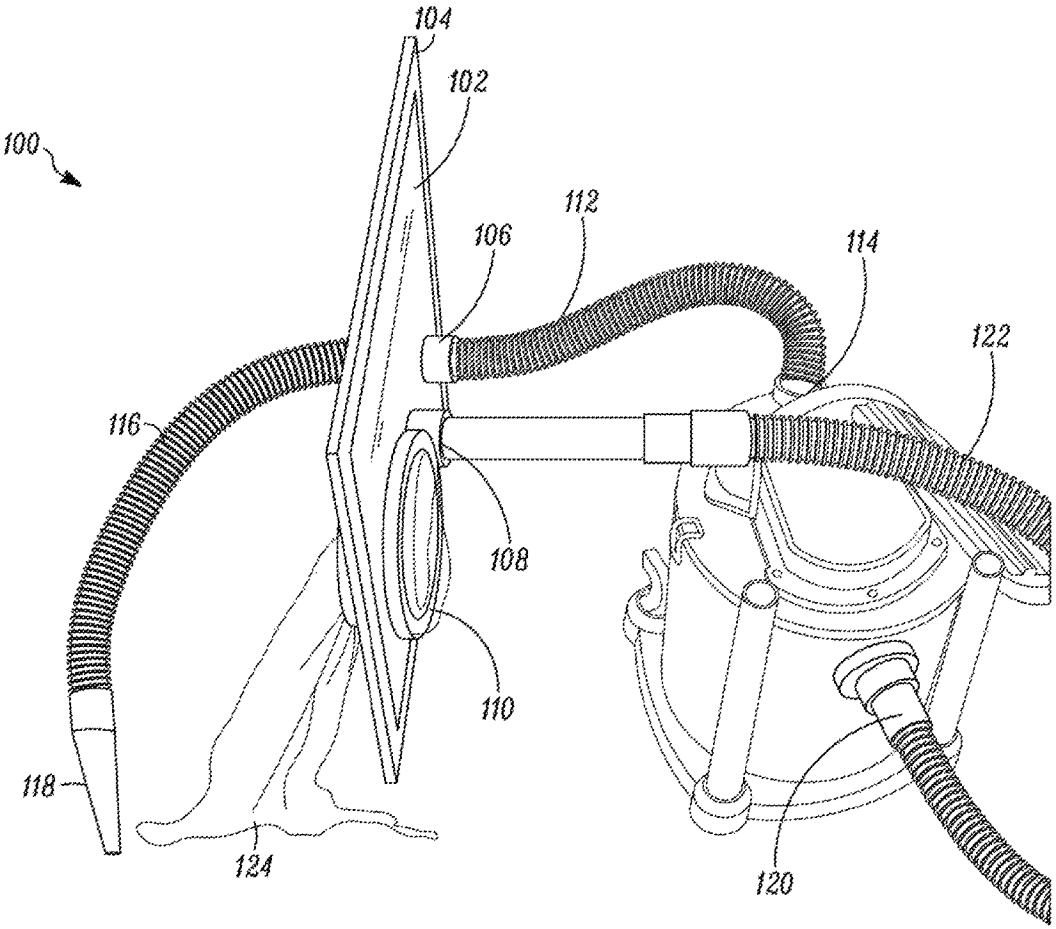
FIG. 3 is a side-view drawing illustrating an exemplary portable vacuum cleaning apparatus with a glove and a shop vacuum for a combustion chamber.
Figure 4:
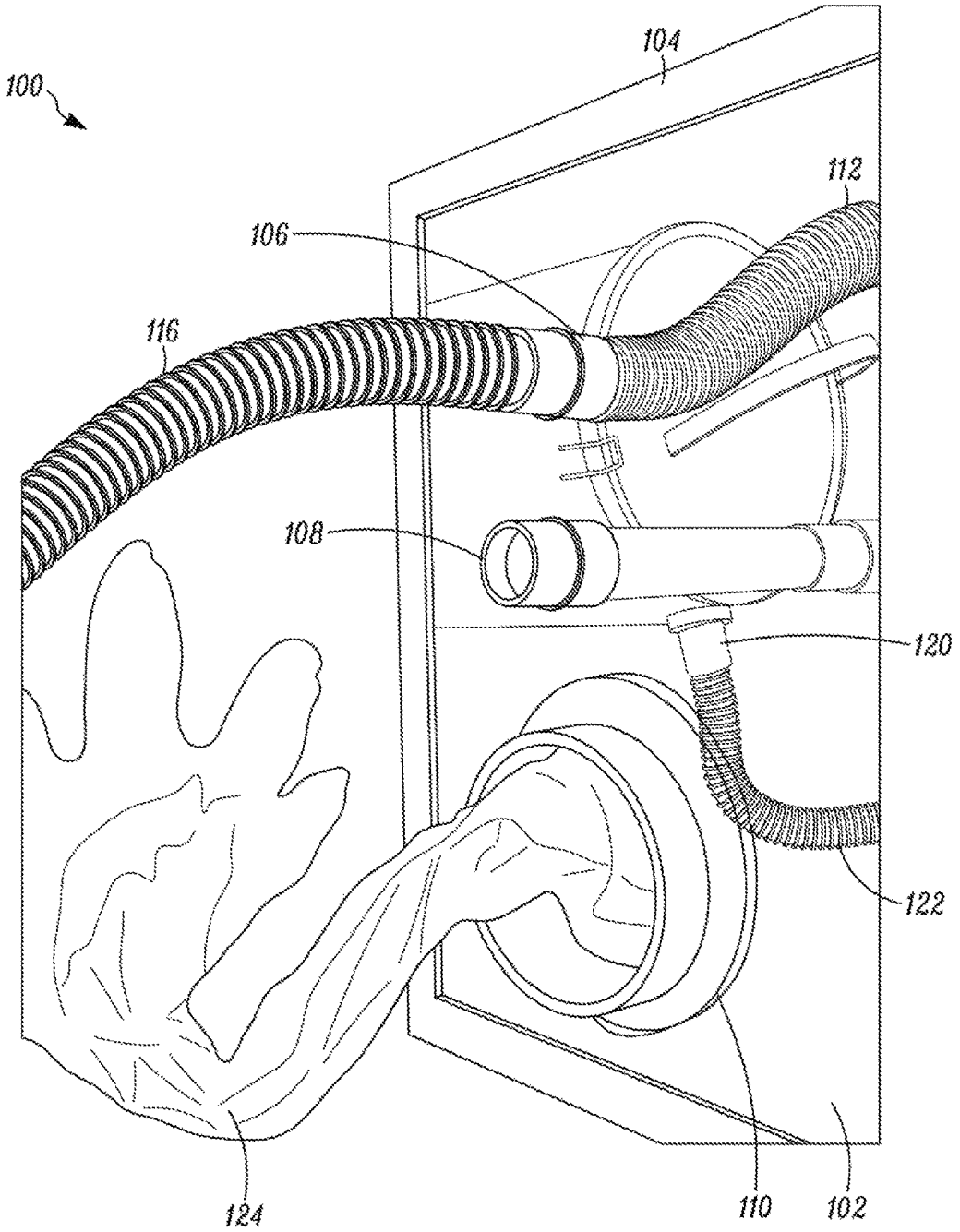
FIG. 4 is a rear perspective-view drawing illustrating an exemplary portable vacuum cleaning apparatus with a glove and a shop vacuum for a combustion chamber.

FIGS. 3-4 are side-view and front-perspective view drawings illustrating an exemplary portable vacuum cleaning apparatus 100 for a combustion chamber (not shown). The portable vacuum cleaning apparatus 100 includes: a shield 102 with one or more connectors 104 each independently configured to provide an air tight seal with an opening (not shown) of a combustion chamber (not shown); a first aperture fitting 106 protruding through the shield 102 and connected a first air hose 112 with an air source 114 and a second air hose 116 with a nozzle 118; a second aperture fitting 108 protruding through the shield 102 and connected to a vacuum source 120 with a vacuum hose 122; and a third aperture fitting 110 protruding through the shield 102 and connected to a glove 124.

Figure 5:
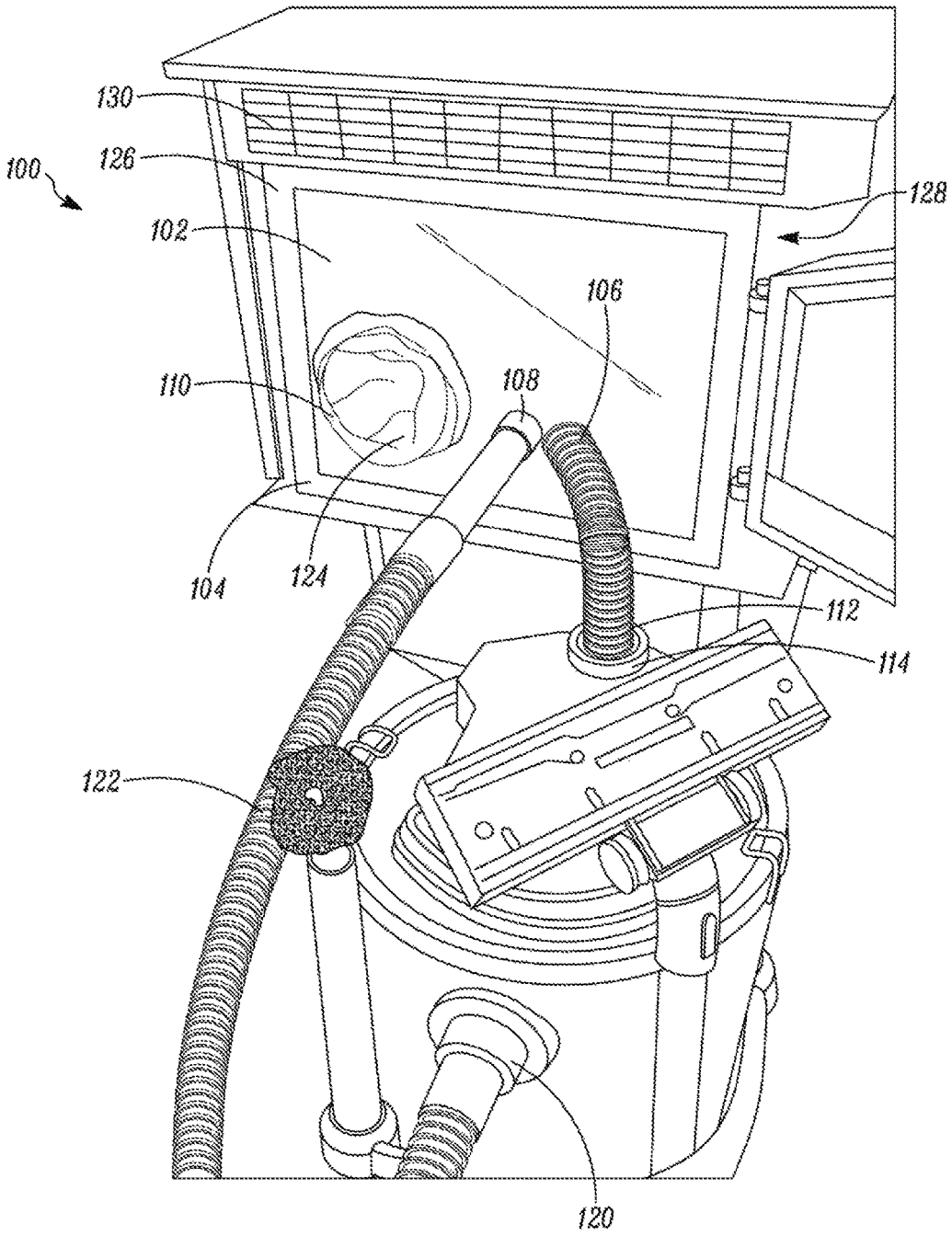
FIG. 5 is a front-view drawing illustrating an exemplary portable vacuum cleaning apparatus connected to a vacuum source and mounted on the front opening of a wood metal stove.

FIG. 5 a front-perspective view drawing illustrating an exemplary portable vacuum cleaning apparatus 100 for a combustion chamber 126. The portable vacuum cleaning apparatus 100 includes: a shield 102 with one or more connectors 104 each independently configured to provide an air tight seal with an opening 128 of a combustion chamber 126; a first aperture fitting 106 protruding through the shield 102 and connected a first air hose 112 with an air source 114 and a second air hose (not shown) with a nozzle (not shown); a second aperture fitting 108 protruding through the shield 102 and connected to a vacuum source 120 with a vacuum hose 122; and a third aperture fitting 110 protruding through the shield 102 and connected to a glove 124.

In one embodiment, the combustion chamber 126 is a metal wood stove 130. In one embodiment, the combustion chamber 126 is a pellet burning metal wood stove. In one embodiment, the combustion chamber 126 is a metal fireplace, or metal fireplace screen. In one embodiment, the combustion chamber 126 is made of a ferromagnetic metal that is attracted to magnets.

In one embodiment, the metal wood stove 130, the pellet burning metal wood stove, or the metal fireplace are each independently configured to burn wood, charcoal, coal, corn, hay, straw, or a combination thereof The shield 102 has a first surface, a second surface, and one or more edges. In one embodiment, the shield 102 is transparent. In one embodiment, the shield 102 includes an opaque section and a transparent section. In one embodiment, the shield 102 is made of glass. In one embodiment, the shield 102 is made of a transparent plastic material. The transparent plastic material may include, for example, a polycarbonate or an acrylic plastic material.

Around the edges of the shield 102 are one or more connectors 104. In one embodiment, the one or more connectors 104 are magnets. In one embodiment, the one or more connectors 104 are one or more magnetic strips. In one embodiment, the one or more connectors 104 are one or more adhesive strips. In one embodiment, the one or more adhesive strips are repositionable.

In one embodiment, the first aperture fitting 106 is connected a first air hose 112 with a hose clamp (not shown). In one embodiment, the first aperture fitting 106 is connected to the second air hose 116 with a hose clamp (not shown). In one embodiment, the second air hose 116 is connected to the nozzle 118 with a hose clamp (not shown). In one embodiment, the second aperture fitting 108 connected to the vacuum hose 122 with a hose clamp (not shown).

In one embodiment, the air source 114 is a compressed air source. In one embodiment, the air source 114 is an exhaust port of a shop vacuum 114. In one embodiment, the vacuum source is an intake port of a shop vacuum 120.

In one embodiment, the glove 124 is a rubber glove, a nitrile glove, or a combination thereof. In one embodiment, the glove 124 is connected to the third aperture fitting 110 with a hose clamp (not shown).

To use the portable vacuum cleaning apparatus 100, the user should perform the following steps. First, the user should turn off the combustion chamber 126 and allow it to cool and the embers die out. Second, the user should next vacuum as much of the ash from the combustion chamber 126 as possible. Third, the user should connect the first air hose 112 with an air source 114 and a second air hose 116 with a nozzle 118 to the first aperture fitting 106 protruding through the shield 102. Fourth, the user should connect the vacuum hose 122 to the second aperture fitting 108 and to the vacuum source 120. Fifth, the user should connect the glove 124 to the third aperture fitting 110. Sixth, the user should place the portable vacuum cleaning apparatus 100 over the opening of the combustion chamber 126. The one or more connectors 104 should form an air-tight seal around the opening 128 of a combustion chamber 126. Finally, the user should turn on the shop-vacuum, place their hand in the glove 124 to grab the nozzle 118, and direct the air stream coming out of the nozzle 118 toward the unremoved debris that will then be sucked out of the combustion chamber 126 by the applied vacuum through the second aperture fitting 108.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance or component fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A portable vacuum cleaning apparatus equipped to mount over an opening in a wood stove, a pellet burning wood stove, a fireplace, or a fireplace screen to allow a user to clean the wood stove, the pellet burning wood stove, or the fireplace without an emission of ash from the wood stove, the pellet burning wood stove, or the fireplace, the portable vacuum cleaning apparatus comprising:

a transparent shield having a first surface, a second surface, and one or more edges, wherein the one or more edges on the second surface of the transparent shield each independently comprise one or more connectors each independently comprising one or more adhesive strips or one or more magnets to provide an air tight seal over the opening in the wood stove, the pellet burning wood stove, the fireplace, or the fireplace screen;

a first aperture fitting having a proximal end, a distal end, and protruding through the transparent shield, wherein the proximal end of the first aperture fitting is coupled to a first air hose in fluid connection with an air source and the distal end of the first aperture fitting is coupled to a second air hose in fluid connection with a nozzle, wherein the air source provides an air stream exiting from the air source through the first air hose, the second air hose, and the nozzle;

a second aperture fitting having a proximal end, a distal end, and protruding through the transparent shield, wherein the proximal end of the second aperture fitting is coupled to a vacuum hose in fluid connection with a vacuum port of a shop vacuum, wherein the shop vacuum provides a vacuum entering from the vacuum port of the shop vacuum through the vacuum hose;

a third aperture fitting having a proximal end, a distal end, and protruding through the transparent shield, and wherein the proximal end or the distal end of the third aperture fitting comprises a glove.

2. The portable vacuum cleaning apparatus of claim 1, wherein the air source comprises an exhaust port of the shop vacuum.

3. The portable vacuum cleaning apparatus of claim 1, wherein the air source comprises an air compressor.

4. The portable vacuum cleaning apparatus of claim 1, wherein the one or more connectors comprise one or more magnets and wherein the wood stove, the pellet burning wood stove, the fireplace, or the fireplace screen each independently comprise one or more ferromagnetic metals.

5. The portable vacuum cleaning apparatus of claim 1, wherein the one or more adhesive strips or the one or more magnets are repositionable.

6. A portable vacuum cleaning apparatus equipped to mount over an opening in a wood stove, a pellet burning wood stove, a fireplace, or a fireplace screen to allow a user to clean the wood stove, the pellet burning wood stove, or the fireplace without an emission of ash from the wood stove, the pellet burning wood stove, or the fireplace, the portable vacuum cleaning apparatus comprising:

a transparent shield having a first surface, a second surface, and one or more edges, wherein the one or more edges on the second surface of the transparent shield each independently comprise one or more connectors each independently comprising one or more adhesive strips or one or more magnets to provide an air tight seal over the opening in the wood stove, the pellet burning wood stove, the fireplace, or the fireplace screen;

a first aperture fitting having a proximal end, a distal end, and protruding through the transparent shield, wherein the proximal end of the first aperture fitting is coupled to a first air hose in fluid connection with an air compressor and the distal end of the first aperture fitting is coupled to a second air hose in fluid connection with a nozzle, wherein the air compressor provides an air stream exiting from the air compressor through the first air hose, the second air hose, and the nozzle;

a second aperture fitting having a proximal end, a distal end, and protruding through the transparent shield, wherein the proximal end of the second aperture fitting is coupled to a vacuum hose in fluid connection with a vacuum port of a shop vacuum, wherein the shop vacuum provides a vacuum entering from the vacuum port of the shop vacuum through the vacuum hose;

a third aperture fitting having a proximal end, a distal end, and protruding through the transparent shield, and wherein the proximal end or the distal end of the third aperture fitting comprises a glove.

7. The portable vacuum cleaning apparatus of claim 6, wherein the one or more connectors comprise one or more magnets and wherein the wood stove, the pellet burning wood stove, the fireplace, or the fireplace screen each independently comprise one or more ferromagnetic metals.

8. The portable vacuum cleaning apparatus of claim 6, wherein the one or more adhesive strips or the one or more magnets are repositionable.

9. A portable vacuum cleaning apparatus equipped to mount over an opening in a wood stove, a pellet burning wood stove, a fireplace, or a fireplace screen to allow a user to clean the wood stove, the pellet burning wood stove, or the fireplace without an emission of ash from the wood stove, the pellet burning wood stove, or the fireplace, the portable vacuum cleaning apparatus comprising:

a transparent shield having a first surface, a second surface, and one or more edges, wherein the one or more edges on the second surface of the transparent shield each independently comprise one or more connectors each independently comprising one or more adhesive strips or one or more magnets to provide an air tight seal over the opening in the wood stove, the pellet burning wood stove, the fireplace, or the fireplace screen;

a first aperture fitting having a proximal end, a distal end, and protruding through the transparent shield, wherein the proximal end of the first aperture fitting is coupled to a first air hose in fluid connection with an exhaust port of a shop vacuum and the distal end of the first aperture fitting is coupled to a second air hose in fluid connection with a nozzle, wherein the shop vacuum provides an air stream exiting from the exhaust port of the shop vacuum through the first air hose, the second air hose, and the nozzle;

a second aperture fitting having a proximal end, a distal end, and protruding through the transparent shield, wherein the proximal end of the second aperture fitting is coupled to a vacuum hose in fluid connection with a vacuum port of the shop vacuum, wherein the shop vacuum provides a vacuum entering from the vacuum port of the shop vacuum through the vacuum hose;

a third aperture fitting having a proximal end, a distal end, and protruding through the transparent shield, and wherein the proximal end or the distal end of the third aperture fitting comprises a glove.

10. The portable vacuum cleaning apparatus of claim 9, wherein the one or more connectors comprise one or more magnets and wherein the wood stove, the pellet burning wood stove, the fireplace, or the fireplace screen each independently comprise one or more ferromagnetic metals.

11. The portable vacuum cleaning apparatus of claim 9, wherein the one or more adhesive strips or the one or more magnets are repositionable.

* * * * *